US011381038B1

(12) United States Patent
Patel

(10) Patent No.: US 11,381,038 B1
(45) Date of Patent: Jul. 5, 2022

(54) CONTACT ASSEMBLY WITH GROUND BUS

(71) Applicant: TE Connectivity Services GmbH, Schaffhausen (CH)

(72) Inventor: Sandeep Patel, Littleton, CO (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 17/147,118

(22) Filed: Jan. 12, 2021

(51) Int. Cl.

| | |
|---|---|
| ***H01R 13/6471*** | (2011.01) |
| ***H01R 13/6588*** | (2011.01) |
| ***H01R 13/6583*** | (2011.01) |
| ***H01R 13/6592*** | (2011.01) |
| ***H01R 24/60*** | (2011.01) |
| ***H01R 12/71*** | (2011.01) |

(52) U.S. Cl.
CPC ..... *H01R 13/6471* (2013.01); *H01R 12/714* (2013.01); *H01R 13/6583* (2013.01); *H01R 13/6588* (2013.01); *H01R 13/6592* (2013.01); *H01R 24/60* (2013.01)

(58) Field of Classification Search
CPC ..... H01R 13/6461; H01R 13/6463; H01R 13/6471; H01R 13/6583; H01R 13/6588; H01R 13/6585; H01R 13/65914; H01R 13/6593; H01R 13/6592; H01R 13/6597; H01R 12/714; H01R 12/72; H01R 12/721; H01R 24/60
USPC ..... 439/108, 98, 607.41, 607.52, 607.45, 439/607.47, 636, 637
See application file for complete search history.

(56) References Cited

U.S. PATENT DOCUMENTS 6,634,894 B1 * 10/2003 Ko ..... H01R 12/00 439/108
6,705,896 B1 * 3/2004 Chang ..... H01R 13/65914 439/98
6,755,687 B1 * 6/2004 Ko ..... H01R 4/024 439/607.41
6,830,478 B1 * 12/2004 Ko ..... H01R 12/598 439/607.41
6,913,485 B2 * 7/2005 Ko ..... H01R 9/0512 439/607.41
7,717,733 B1 * 5/2010 Yi ..... H01R 13/58 439/607.41
8,337,243 B2 * 12/2012 Elkhatib ..... H01R 12/594 439/581

(Continued)

FOREIGN PATENT DOCUMENTS

CN 111834776 A * 10/2020 ..... H01R 12/716

*Primary Examiner* — Marcus E Harcum

(57) ABSTRACT

A contact assembly includes a leadframe having signal contacts and ground contacts. The contacts include intermediate portions extending between mating and terminating ends. The ground terminating end has a leadframe ground bus connecting each of the ground contacts. The electrical connector includes a contact holder holding the contacts. The electrical connector includes cables terminated to the leadframe including signal conductors terminated to corresponding signal terminating ends. The leadframe ground bus is terminated to each of the ground shields to electrically common the ground shields. The electrical connector includes an external ground bus separate and discrete from the leadframe ground bus terminated to each of the ground shields at an opposite side of the cables from the leadframe ground bus to electrically common the ground shields.

20 Claims, 6 Drawing Sheets

(56) References Cited

U.S. PATENT DOCUMENTS

| | | | | |
|---|---|---|---|---|
| 8,727,803 | B2 * | 5/2014 | Kurachi | H01R 13/639 439/497 |
| 8,956,167 | B2 * | 2/2015 | Wu | H01R 13/6471 439/98 |
| 9,437,949 | B2 * | 9/2016 | Behziz | H01R 13/6588 |
| 10,109,937 | B2 * | 10/2018 | Zerebilov | H01R 24/22 |
| 10,193,262 | B2 | 1/2019 | Henry | |
| 10,403,565 | B1 * | 9/2019 | Henry | H01L 23/49517 |
| 10,424,878 | B2 * | 9/2019 | Lloyd | H01R 12/716 |
| 10,680,364 | B2 * | 6/2020 | Champion | H01R 13/6594 |
| 10,699,823 | B2 * | 6/2020 | Blackburn | H04B 3/30 |
| 10,714,237 | B1 * | 7/2020 | Hamner | H01R 24/56 |
| 10,873,160 | B2 * | 12/2020 | Henry | H01R 12/72 |
| 2004/0002262 | A1 * | 1/2004 | Murayama | H01R 13/65918 439/607.1 |
| 2008/0305689 | A1 * | 12/2008 | Zhang | H01R 13/6585 439/638 |
| 2010/0294530 | A1 * | 11/2010 | Atkinson | H01R 13/65914 174/78 |
| 2013/0244482 | A1 * | 9/2013 | Kondo | H01R 43/16 29/874 |
| 2014/0170897 | A1 * | 6/2014 | Nonen | H01R 13/5829 29/857 |
| 2016/0218455 | A1 * | 7/2016 | Sayre | H01R 13/6594 |
| 2019/0356086 | A1 * | 11/2019 | Smith | H01R 13/5808 |
| 2021/0091491 | A1 * | 3/2021 | Wang | H01R 12/62 |
| 2021/0126404 | A1 * | 4/2021 | Laurx | H01R 12/75 |

* cited by examiner

CONTACT ASSEMBLY WITH GROUND BUS

BACKGROUND OF THE INVENTION

The subject matter herein relates generally to electrical connectors.

Electrical connectors are typically used to electrically couple various types of electrical devices to transmit signals between the devices. At least some known electrical connectors include a cable assembly having cables connected between the electrical device and the electrical connector. The cables each have a signal conductor or a differential pair of signal conductors surrounded by a shield layer that, in turn, is surrounded by a cable jacket. The shield layer includes a conductive foil, which functions to shield the signal conductor(s) from electromagnetic interference (EMI) and generally improve performance. At an end of the communication cable, the cable jacket, the shield layer, and insulation that covers the signal conductor(s) may be removed (e.g., stripped) to expose the signal conductor(s). The exposed portions of the conductor(s) may then be mechanically and electrically coupled (e.g., soldered) to corresponding elements of an electrical device. However, the lack of shielding in the exposed portions may cause a high impedance mismatch and reduce the overall performance of the device.

Accordingly, there is a need for an electrical connector having improved electrical shielding.

BRIEF DESCRIPTION OF THE INVENTION

In one embodiment, a contact assembly for an electrical connector is provided. The electrical connector includes a leadframe having an array of contacts include signal contacts and ground contacts. The ground contacts are interspersed with the signal contacts to provide electrical shielding between corresponding signal contacts. Each signal contact includes a signal intermediate portion extending between a signal mating end and a signal terminating end. Each ground contact includes a ground intermediate portion extending between a ground mating end and a ground terminating end. The ground terminating end has a leadframe ground bus connecting each of the ground contacts. The electrical connector includes a contact holder holding the array of contacts. The contact holder is a dielectric material. The contact holder holds each of the signal intermediate portions and holds each of the ground intermediate portions. The signal mating ends, and the ground mating ends extend forward of the contact holder. The signal terminating ends and the ground terminating ends extending rearward of the contact holder. The electrical connector includes cables terminated to the leadframe. The cables include signal conductors and ground shields surrounding the corresponding signal conductors to provide electrical shielding for the signal conductors. The signal conductors are terminated to corresponding signal terminating ends. The leadframe ground bus are terminated to each of the ground shields to electrically common the ground shields and the leadframe ground bus. The electrical connector includes an external ground bus separate and discrete from the leadframe ground bus. The external ground bus are terminated to each of the ground shields at an opposite side of the cables from the leadframe ground bus to electrically common the ground shields and the external ground bus.

In a further embodiment, a contact assembly for an electrical connector is provided. The electrical connector includes a leadframe having an array of contacts including signal contacts and ground contacts. The signal contacts are arranged in pairs. The ground contacts interspersed between the pairs of the signal contacts to provide electrical shielding between the corresponding signal contacts. Each signal contact includes a signal intermediate portion extending between a signal mating end and a signal terminating end. Each ground contact includes a ground intermediate portion extending between a ground mating end and a ground terminating end. The ground terminating end has a leadframe ground bus connecting each of the ground contacts. The leadframe ground bus include connecting portions between the ground contacts. The electrical connector includes a contact holder holding the array of contacts. The contact holder is a dielectric material. The contact holder holds each of the signal intermediate portions and holds each of the ground intermediate portions. The signal mating ends, and the ground mating ends extend forward of the contact holder. The signal terminating ends and the ground terminating ends extend rearward of the contact holder. The electrical connector includes cables terminated to the leadframe. The cables include signal conductors and ground shields surrounding the corresponding signal conductors to provide electrical shielding for the signal conductors. The signal conductors are terminated to corresponding signal terminating ends. The connecting portions of the leadframe ground bus are aligned with the cables and are terminated to the ground shields of the corresponding cables to electrically common the ground shields and the leadframe ground bus. The electrical connector includes an external ground bus separate and discrete from the leadframe ground bus. The external ground bus has ground beams and connecting portions between the ground beams. The ground beams are aligned with and coupled to the corresponding ground contacts. The connecting portions of the external ground bus are aligned with the cables and are terminated to the ground shields of the corresponding cables at an opposite side of the cables from the leadframe ground bus. The external ground bus electrically commoning the ground shields and the external ground bus.

In a further embodiment, an electrical connector is provided. The electrical connector includes a housing has a cavity receiving an upper contact assembly and a lower contact assembly. The housing includes a card slot at a mating end of the housing configured to receive a card edge of a circuit card of a mating connector. The upper contact assembly includes an upper leadframe having an array of upper contacts including upper signal contacts and upper ground contacts. The upper ground contacts are interspersed with the upper signal contacts to provide electrical shielding between corresponding upper signal contacts. Each upper signal contact includes an upper signal intermediate portion extending between an upper signal mating end and an upper signal terminating end. Each upper ground contact includes an upper ground intermediate portion extending between an upper ground mating end and an upper ground terminating end. The upper ground terminating end has an upper leadframe ground bus connecting each of the upper ground contacts. The upper signal mating ends and the upper ground mating ends located in the card slot for mating with the circuit card. The upper contact assembly includes an upper contact holder holding the array of upper contacts. The upper contact holder is a dielectric material. The upper contact holder holding each of the upper signal intermediate portions and holding each of the upper ground intermediate portions. The upper signal mating ends and the upper ground mating ends extend forward of the upper contact holder. The upper signal terminating ends and the upper ground terminating ends extend rearward of the upper contact holder. The upper contact assembly includes upper cables terminated to the upper leadframe. The upper cables include upper signal conductors and upper ground shields surrounding the corresponding upper signal conductors to provide electrical shielding for the upper signal conductors. The upper signal conductors are terminated to corresponding upper signal terminating ends. The upper leadframe ground bus are terminated to each of the upper ground shields to electrically common the upper ground shields and the upper leadframe ground bus. The upper contact assembly includes an upper external ground bus separate and discrete from the upper leadframe ground bus. The upper external ground bus are terminated to each of the upper ground shields at an opposite side of the upper cables from the upper leadframe ground bus to electrically common the upper ground shields and the upper external ground bus. The lower contact assembly includes a lower leadframe having an array of lower contacts including lower signal contacts and lower ground contacts. The lower ground contacts are interspersed with the lower signal contacts to provide electrical shielding between corresponding lower signal contacts. Each lower signal contact includes a lower signal intermediate portion extending between a lower signal mating end and a lower signal terminating end. Each lower ground contact includes a lower ground intermediate portion extending between a lower ground mating end and a lower ground terminating end. The lower ground terminating end has a lower leadframe ground bus connecting each of the lower ground contacts. The lower signal mating ends and the lower ground mating ends located in the card slot for mating with the circuit card. The lower contact assembly includes a lower contact holder holding the array of lower contacts. The lower contact holder is coupled to the upper contact holder. The lower contact holder is a dielectric material. The lower contact holder holding each of the lower signal intermediate portions and holding each of the lower ground intermediate portions. The lower signal mating ends and the lower ground mating ends extending forward of the lower contact holder. The lower signal terminating ends and the lower ground terminating ends extending rearward of the lower contact holder. The lower contact assembly includes lower cables terminated to the lower leadframe. The lower cables include lower signal conductors and lower ground shields surrounding the corresponding lower signal conductors to provide electrical shielding for the lower signal conductors. The lower signal conductors are terminated to corresponding lower signal terminating ends. The lower leadframe ground bus are terminated to each of the lower ground shields to electrically common the lower ground shields and the lower leadframe ground bus. The lower contact assembly includes a lower external ground bus separate and discrete from the lower leadframe ground bus. The lower external ground bus are terminated to each of the lower ground shields at an opposite side of the lower cables from the lower leadframe ground bus to electrically common the lower ground shields and the lower external ground bus.

DETAILED DESCRIPTION OF THE INVENTION

Figure 1:
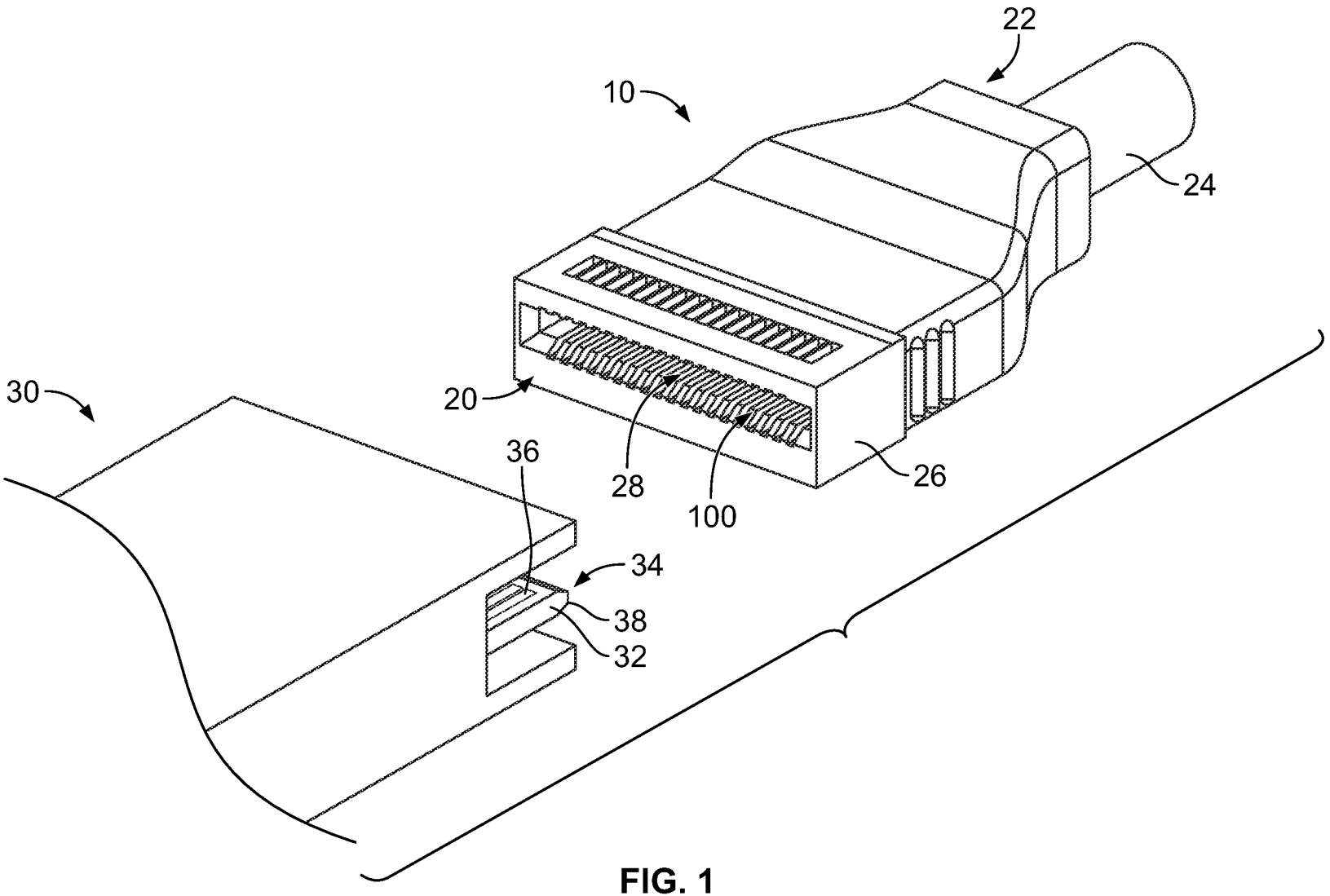
FIG. 1 is a perspective view of an electrical connector formed in accordance with one embodiment.

FIG. 1 is a perspective view of an electrical connector 10 formed in accordance with one embodiment. The electrical connector 10 is configured to be mated with a mating electrical connector 30. In an exemplary embodiment, the electrical connector 10 has a mating end 20, a cable end 22, and one or more cables 24 extending from the cable end 22. The electrical connector 10 includes a housing 26 configured to hold a contact assembly 100. In an exemplary embodiment, the housing 26 includes a card slot 28 at the mating end 20. In the illustrated embodiment, the electrical connector 10 is a communication device, such as a serial attached SCSI (SAS) connector. However, the electrical connector 10 may be another type of electrical connector in an alternative embodiment. For example, the electrical connector 10 may define a socket or receptacle connector, such as a card edge socket connector.

The mating electrical connector 30 is configured to be mated with the electrical connector 10. In an exemplary embodiment, the mating electrical connector 30 has a circuit card 32 at a mating end 34 of the mating electrical connector 30. The circuit card 32 includes mating contacts 36 at a card edge 38 of the circuit card 32. The connectors 10, 30 may be a high-speed connectors that transmit data signals at speeds over 10 gigabits per second (Gbps), such as over 25 Gbps. The connectors 10, 30 may be input-output (I/O) connectors.

Figure 2:
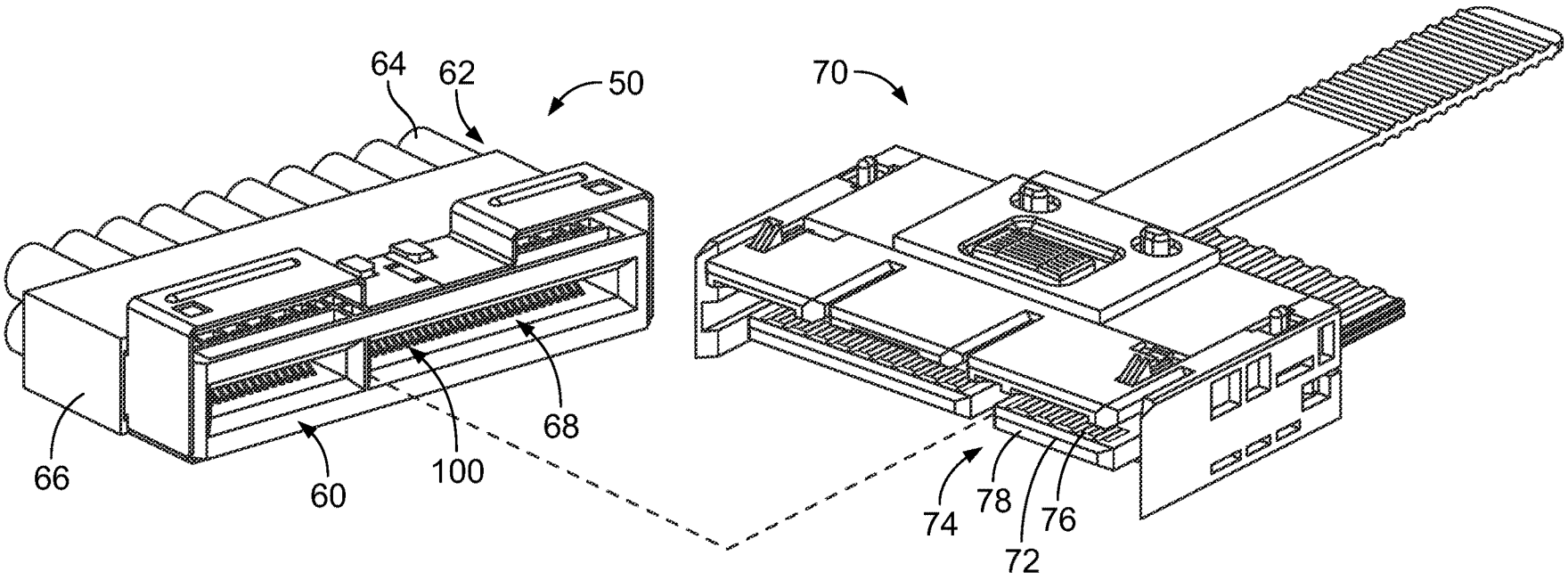
FIG. 2 is a perspective view of an electrical connector formed in accordance with one embodiment.

FIG. 2 is a perspective view of an electrical connector 50 formed in accordance with one embodiment. The electrical connector 50 is configured to be mated with a mating electrical connector 70. In an exemplary embodiment, the electrical connector 50 has a mating end 60, a cable end 62, and one or more cables 64 extending from the cable end 62. The electrical connector 50 includes a housing 66 configured to hold the contact assembly 100. In an exemplary embodiment, the housing 66 includes a card slot 68 at the mating end 60. In an exemplary embodiment, the mating electrical connector 70 has a circuit card 72 at a mating end 74 of the mating electrical connector 70. The circuit card 72 includes mating contacts 76 at a card edge 78 of the circuit card 72.

Figure 3:
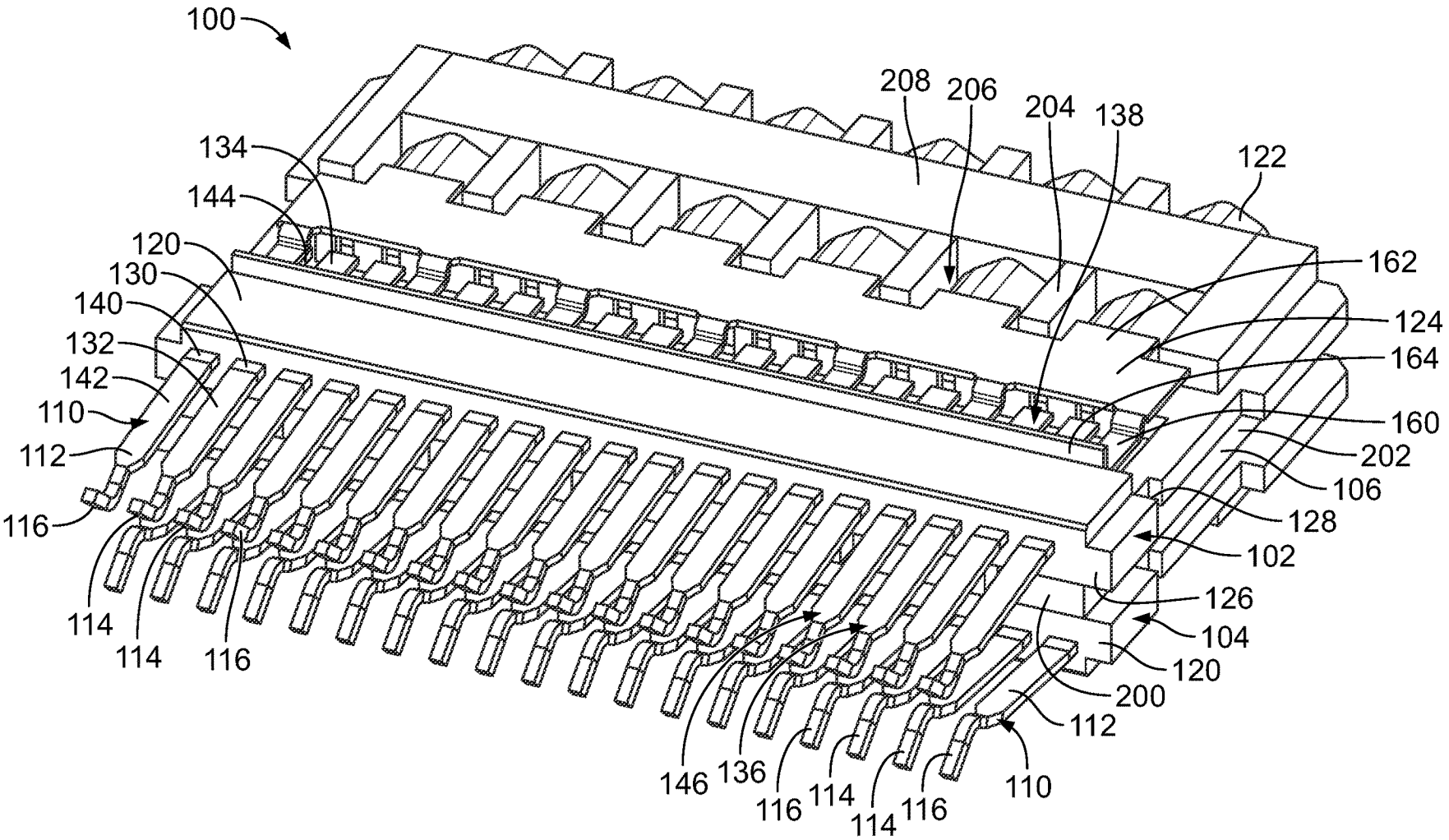
FIG. 3 is a perspective view of a contact assembly of the formed in accordance with one embodiment.

FIG. 3 is a perspective view of the contact assembly 100 formed in accordance with one embodiment. In an exemplary embodiment, the contact assembly 100 includes an upper contact subassembly 102 and a lower contact subassembly 104 coupled to a frame 106. The frame 106 supports the upper and lower contact subassemblies 102, 104. Optionally, the upper and lower contact subassemblies 102, 104 may be identical to each other and inverted 180°. In alternative embodiments, the contact assembly 100 may be provided without the frame 106, rather having the upper and lower contact assemblies coupled directly to each other without an intervening supporting structure. In other alternative embodiments, the contact assembly 100 may be provided with a single contact subassembly, such as provided without the lower contact subassembly 104.

The description herein may be made specifically to the "upper" contact subassembly 102 with the qualifier "upper"

and may be made specifically to the "lower" contact subassembly 104 with the qualifier "lower" or may be made generically to the upper or the lower contact subassemblies 102, 104 without use of the qualifiers "upper" or "lower". The contact assembly 100 includes a leadframe 110 having an array of contacts 112 including signal contacts 114 and ground contacts 116. The contact assembly 100 includes a contact holder 120 holding the array of contacts 112. The contact assembly 100 includes cables 122 terminated to the leadframe 110. The contact assembly 100 includes an external ground bus 124 provided to electrically common the ground contacts 116 and the cables 122.

The contact holder 120 is used to hold the contacts 112, including the signal contacts 114 and the ground contacts 116. The contact holder 120 is manufactured from a dielectric material to electrically isolate the contacts 112 from each other. In an exemplary embodiment, the contact holder 120 is overmolded over the leadframe 110 to encase portions of the contacts 112 and hold relative positions of the contacts 112. The contact holder 120 extends between a front 126 and a rear 128.

In an exemplary embodiment, the contacts 112 are arranged in one or more rows. For example, the upper contacts 112 are arranged in an upper row configured to interface with an upper surface of a circuit card, such as the circuit card 32, and the lower contacts 112 are arranged in a lower row configured to interface with a lower surface of the circuit card. In an exemplary embodiment, the signal contacts 114 are arranged in pairs, such as differential pairs. The ground contacts 116 are interspersed between the signal contacts 114, such as between the pairs of the signal contacts 114, to provide electrical shielding between the corresponding signal contacts 114.

Each signal contact 114 includes a signal intermediate portion 130 extending between a signal mating end 132 and a signal terminating end 134. The contact holder 120 holds the signal intermediate portions 130 relative to each other. The contact holder 120 maintains spacing between the signal contacts 114. The signal mating ends 132 are located forward of the contact holder 120. The signal terminating ends 134 are located rearward of the contact holder 120. In an exemplary embodiment, the signal contacts 114 include spring beams 136 at the signal mating ends 132. The spring beams 136 are deflectable spring beams. The spring beams 136 include separable mating interfaces at or near the distal ends of the spring beams 136. The spring beams 136 may be curved or cupped at the distal ends to prevent stubbing during mating with the circuit card. In an exemplary embodiment, the signal contacts 114 include weld pads 138 at the signal terminating ends 134. The weld pads 138 are configured to be welded to conductors of the cables 122.

Each ground contact 116 includes a ground intermediate portion 140 extending between a ground mating end 142 and a ground terminating end 144. The contact holder 120 holds the ground intermediate portions 140 relative to each other and relative to the signal intermediate portions 130. The ground mating ends 142 are located forward of the contact holder 120. The ground terminating ends 144 are located rearward of the contact holder 120. In an exemplary embodiment, the ground contacts 116 include spring beams 146 at the ground mating ends 142. The spring beams 146 are deflectable spring beams. The spring beams 146 include separable mating interfaces at or near the distal ends of the spring beams 146. The spring beams 146 may be curved or cupped at the distal ends to prevent stubbing during mating with the circuit card. In an exemplary embodiment, the ground contacts 116 include a leadframe ground bus 150 (shown in FIG. 4) at the ground terminating ends 144. The leadframe ground bus 150 electrically commons each of the ground contacts 116 with the cables 122 and with each other. The leadframe ground bus 150 is separate and discrete from the external ground bus 124.

During assembly, the upper and lower contact subassemblies 102, 104 are coupled to the frame 106. The frame 106 includes a platform 200 at a front of the frame 106. The upper and lower contact holders 120 are coupled to the platform 200, such as to upper and lower surfaces of the platform 200, respectively. The frame 106 includes a cable support tray 202 rearward of the platform 200. The cable support tray 202 supports the cables 122, such as along upper and lower surfaces of the cable support tray 202. The cable support tray 202 includes separating walls 204 forming cable channels 206 that receive corresponding cables 122. In an exemplary embodiment, the frame 106 includes a strain relief element 208 providing strain relief for the cables 122. The strain relief element 208 is coupled to the cable support tray 202. During assembly, the cables 122 are received in the cable channels 206 and terminated to the leadframe 110. Signal conductors 210 (shown in FIG. 4) of the cables 122 are terminated to the signal contacts 114. The external ground bus 124 and the leadframe ground bus 150 are terminated to ground shields 212 of the cables 122.

The external ground bus 124 is separate and discrete from the leadframe ground bus 150. Both the external ground bus 124 and the leadframe ground bus 150 are electrically connected to the ground shields 212 of the cables 122 to electrically common the ground shields 212. In an exemplary embodiment, the external ground bus 124 and the leadframe ground bus 150 are coupled to opposite sides of the ground shields 212 of the cables 122 to provide shielding both above and below the cables 122. The external ground bus 124 includes ground fingers 160 and connecting portions 162 between the ground fingers 160. The ground fingers 160 are aligned with and coupled to the corresponding ground contacts 116. The connecting portions 162 are aligned with the cables 122 and terminated to the ground shields 212 of the corresponding cables 122 at an opposite side of the cables 122 from the leadframe ground bus 150. The external ground bus 124 electrically commons each of the ground shields 212. The external ground bus 124 is coupled to the ground contacts 116 to electrically common the external ground bus 124 with the leadframe ground bus 150. In an exemplary embodiment, the external ground bus 124 includes a connecting beam 164 extending between and connecting each of the ground fingers 160. The connecting beam 164 commons each of the ground fingers 160. The connecting beam 164 is spaced apart from the connecting portions 162. The connecting beam 164 may span across each of the ground fingers 160, such as at the front of the external ground bus 124. The connecting beam 164 may abut against the contact holder 120 to position the external ground bus 124 relative to the contact holder 120. The connecting beam 164 may extend generally perpendicular relative to the ground fingers 160. For example, the connecting beam 164 may extend vertically and the ground fingers 160 may extend horizontally.

Figure 4:
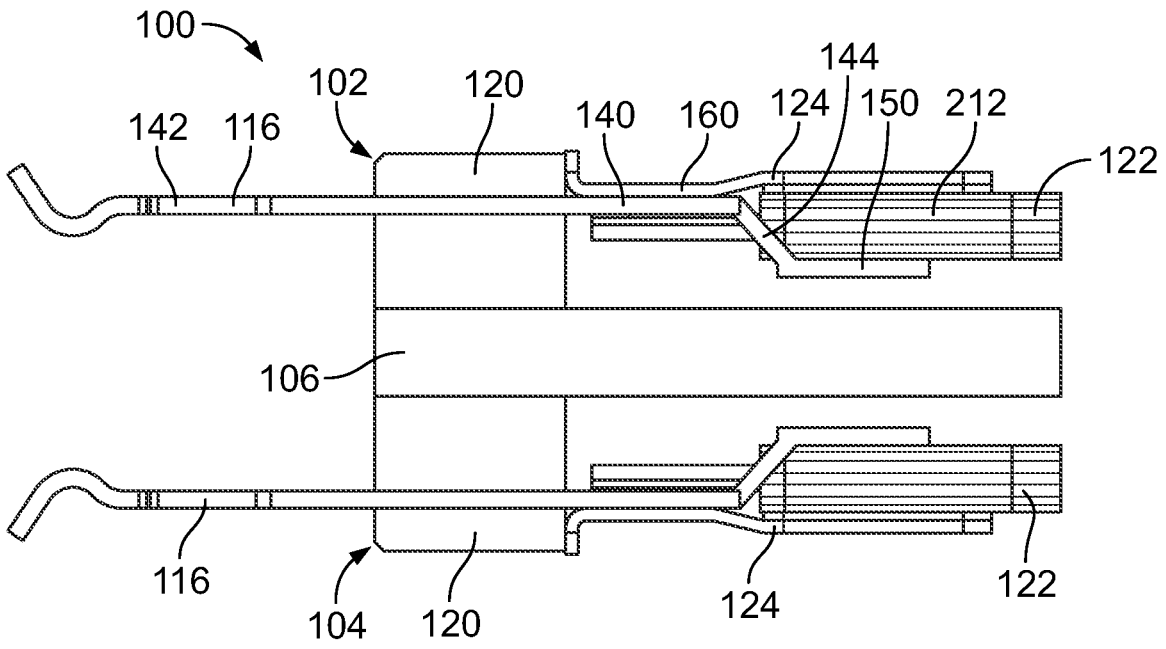
FIG. 4 is a side view of the contact assembly in accordance with an exemplary embodiment.

FIG. 4 is a side view of the contact assembly 100 in accordance with an exemplary embodiment. FIG. 4 illustrates the upper and lower contact subassemblies 102, 104 coupled to the frame 106. The contact holders 120 are coupled to the frame 106. The upper signal contacts 114 and the upper ground contacts 116 are aligned with each other in an upper row and the lower signal contacts 114 and the lower ground contacts 116 are aligned with each other in a lower row. For example, the signal and ground mating ends 132, 142 are aligned with each other. The signal and ground intermediate portions 130, 140 are aligned with each other. The leadframe ground bus 150 at the ground terminating end 144 extends out of plane relative to the signal terminating ends 134.

In an exemplary embodiment, the cable 122 is located between the external ground bus 124 and the leadframe ground bus 150. The cable 122 may be sandwiched between the external ground bus 124 and the leadframe ground bus 150. The external ground bus 124 and the leadframe ground bus 150 are both electrically coupled to the ground shield 212. For example, the external ground bus 124 and the leadframe ground bus 150 may be soldered to the ground shield 212. The external ground bus 124 and the leadframe ground bus 150 provide multiple points of contact with the ground shield 212. Electrical shielding is provided both above and below the ground shield 212 to enhance shielding and electrical performance of the electrical connector 10. In the illustrated embodiment, the upper external ground bus 124 extends above the cable 122 and is coupled to a top side of the cable 122 and the upper leadframe ground bus 150 extends below the cable and is coupled to a bottom side of the cable 122. In the illustrated embodiment, the lower leadframe ground bus 150 extends above the cable 122 and is coupled to a top side of the cable 122 and the lower external ground bus 124 extends below the cable and is coupled to a bottom side of the cable 122.

The ground finger 160 is provided at the front of the external ground bus 124 and extends along the ground contact 116, such as along the ground intermediate portion 140. The ground finger 160 is electrically coupled to the ground contact 116. For example, the ground finger 160 may be welded to the ground contact 116. The electrical connection between the ground finger 160 and the ground contact 116 provides separate points of contact.

Figure 5:
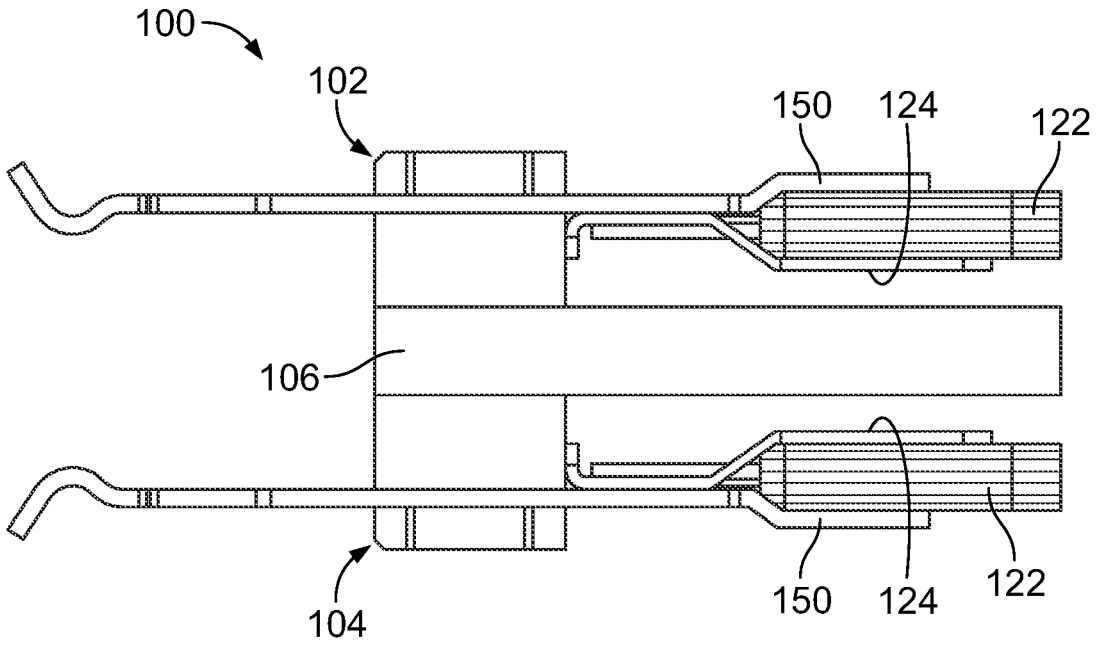
FIG. 5 is a side view of the contact assembly in accordance with an exemplary embodiment.

FIG. 5 is a side view of the contact assembly 100 in accordance with an exemplary embodiment. FIG. 5 illustrates the upper and lower contact subassemblies 102, 104 coupled to the frame 106. In the illustrated embodiment, the external ground bus 124 and the leadframe ground bus 150 are inverted relative to the orientation shown in the embodiment shown in FIG. 4. In the illustrated embodiment, the upper leadframe ground bus 150 extends above the cable 122 and is coupled to a top side of the cable 122 and the upper external ground bus 124 extends below the cable and is coupled to a bottom side of the cable 122. In the illustrated embodiment, the lower external ground bus 124 extends above the cable 122 and is coupled to a top side of the cable 122 and the lower leadframe ground bus 150 extends below the cable and is coupled to a bottom side of the cable 122.

Figure 6:
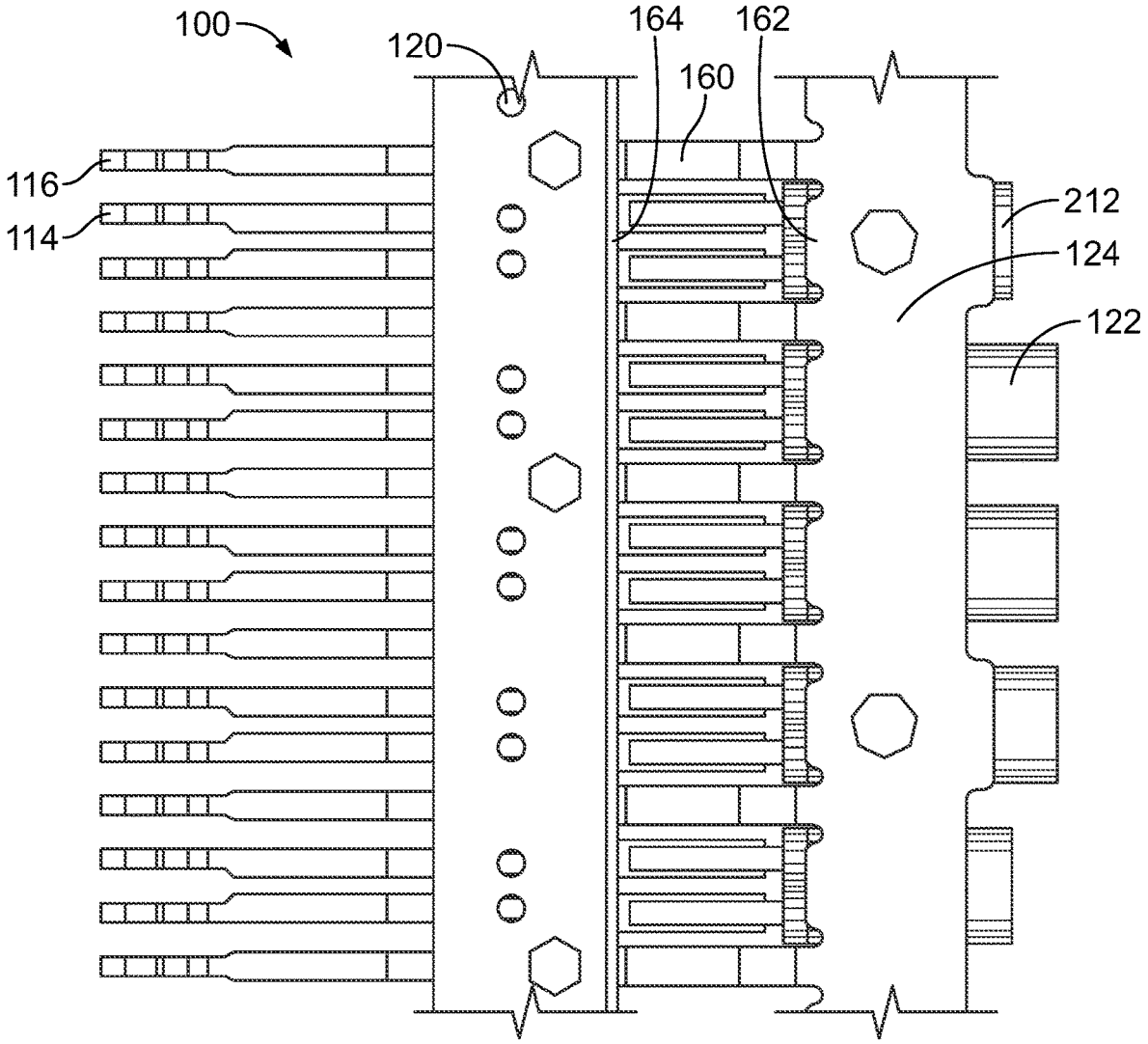
FIG. 6 is a top view of the contact assembly in accordance with an exemplary embodiment.
Figure 7:
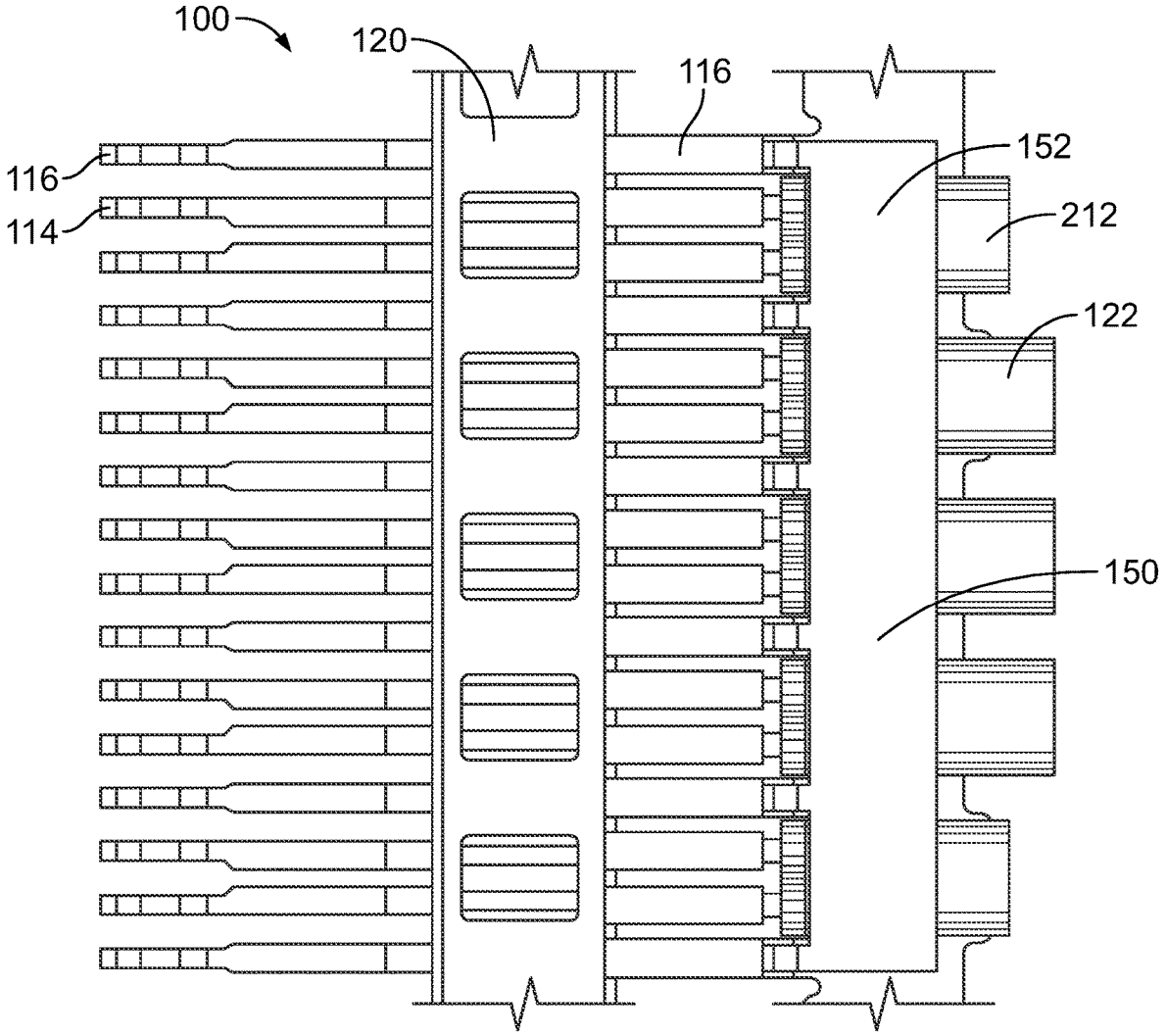
FIG. 7 is a bottom view of the contact assembly in accordance with an exemplary embodiment.

FIG. 6 is a top view of the contact assembly 100 in accordance with an exemplary embodiment. FIG. 7 is a bottom view of the contact assembly 100 in accordance with an exemplary embodiment. The contact holders 120 hold the contacts 122 relative to each other. The external ground bus 124 (FIG. 6) and the leadframe ground bus 150 (FIG. 7) are coupled to the ground shields 212 of each of the cables 122. For example, the external ground bus 124 is soldered to the top sides of the ground shields 212 to mechanically and electrically connect the external ground bus 124 to the ground shields 212. The leadframe ground bus 150 is soldered to the bottom sides of the ground shields 212 to mechanically and electrically connect the leadframe ground bus 150 to the ground shields 212. Having the external ground bus 124 and the leadframe ground bus 150 enhances electrical performance of the electrical connector 10. For example, the shielding on both sides of the cables 122 improves broadband cross talk.

In an exemplary embodiment, the connecting portions 162 (FIG. 6) of the external ground bus 124 are aligned with and coupled to the ground shields 212. Connecting portions 152 (FIG. 7) of the leadframe ground bus 150, which extend between the ground contacts 116, are aligned with and coupled to the ground shields 212. The connecting portions 152, 162 may be soldered to the ground shields 212. With reference to FIG. 6, the connecting beam 164 extends between the ground fingers 160 to common each of the ground fingers 160. The connecting beam 164 is spaced apart from the connecting portions 162. With reference to FIG. 7, the ground contacts 116 extend forward from the leadframe ground bus 150. The ground contacts 116 are located between the signal contacts 114.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact assembly for an electrical connector comprising:

a leadframe having an array of contacts including signal contacts and ground contacts, the ground contacts interspersed with the signal contacts to provide electrical shielding between corresponding signal contacts, each signal contact including a signal intermediate portion extending between a signal mating end and a signal terminating end, each ground contact including a ground intermediate portion extending between a ground mating end and a ground terminating end, the ground terminating end having a leadframe ground bus connecting each of the ground contacts;

a contact holder holding the array of contacts, the contact holder being a dielectric material, the contact holder holding each of the signal intermediate portions and holding each of the ground intermediate portions, the signal mating ends and the ground mating ends extending forward of the contact holder, the signal terminating ends and the ground terminating ends extending rearward of the contact holder;

cables terminated to the leadframe, the cables including signal conductors and ground shields surrounding the corresponding signal conductors to provide electrical shielding for the signal conductors, the signal conductors being terminated to corresponding signal terminating ends, the leadframe ground bus being terminated to each of the ground shields to electrically common the ground shields and the leadframe ground bus; and an external ground bus separate and discrete from the leadframe ground bus, the external ground bus being terminated to each of the ground shields at an opposite side of the cables from the leadframe ground bus to electrically common the ground shields and the external ground bus.

2. The contact assembly of claim 1, wherein the ground shields of the cables are sandwiched between the external ground bus and the leadframe ground bus.

3. The contact assembly of claim 1, wherein the external ground bus is soldered to the ground shields to mechanically and electrically connect the external ground bus to the ground shields, and wherein the leadframe ground bus is soldered to the ground shields to mechanically and electrically connect the leadframe ground bus to the ground shields.

4. The contact assembly of claim 1, wherein the leadframe ground bus includes connecting portions between the ground contacts, the connecting portions being aligned with and coupled to the ground shields of the cables.

5. The contact assembly of claim 1, wherein the external ground bus includes ground fingers and connecting portions located between the ground fingers, the ground fingers being aligned with and welded to the corresponding ground contacts, the connecting portions being aligned with and coupled to the ground shields of the cables.

6. The contact assembly of claim 5, wherein the external ground bus includes a connecting beam extending between and connecting each of the ground fingers to common each of the ground fingers, the connecting beam being spaced apart from the connecting portions.

7. The contact assembly of claim 1, wherein the leadframe ground bus extends above the cables and is coupled to top sides of the cables and the external ground bus extends below the cables and is coupled to bottom sides of the cables.

8. The contact assembly of claim 1, wherein the external ground bus extends above the cables and is coupled to top sides of the cables and the leadframe ground bus extends below the cables and is coupled to bottom sides of the cables.

9. The contact assembly of claim 1, further comprising a strain relief element encasing portions of the signal terminating ends, the ground terminating ends, the leadframe bus bar and the external ground bus.

10. The contact assembly of claim 1, wherein the signal mating ends and the ground mating ends are aligned with each other in a single row, the signal intermediate portions and the ground intermediate portions are aligned with each other in a single row and wherein the signal terminating ends are aligned with each other in a single row, the leadframe bus bar extending out of plane with respect to the signal terminating ends to couple to the ground shields of the cables.

11. The contact assembly of claim 1, wherein the signal mating end of each signal contact includes a spring beam including a separable interface configured to be electrically connected to a mating signal contact of a mating connector, and wherein the ground mating end of each ground contact includes a spring beam including a separable interface configured to be electrically connected to a mating ground contact of the mating connector.

12. The contact assembly of claim 1, wherein the signal terminating end of each signal contact includes a weld tab being welded to the signal conductor of the corresponding cable.

13. A contact assembly for an electrical connector comprising:

a leadframe having an array of contacts including signal contacts and ground contacts, the signal contacts being arranged in pairs, the ground contacts interspersed between the pairs of the signal contacts to provide electrical shielding between the corresponding signal contacts, each signal contact including a signal intermediate portion extending between a signal mating end and a signal terminating end, each ground contact including a ground intermediate portion extending between a ground mating end and a ground terminating end, the ground terminating end having a leadframe ground bus connecting each of the ground contacts, the leadframe ground bus including connecting portions between the ground contacts;

a contact holder holding the array of contacts, the contact holder being a dielectric material, the contact holder holding each of the signal intermediate portions and holding each of the ground intermediate portions, the signal mating ends and the ground mating ends extending forward of the contact holder, the signal terminating ends and the ground terminating ends extending rearward of the contact holder;

cables terminated to the leadframe, the cables including signal conductors and ground shields surrounding the corresponding signal conductors to provide electrical shielding for the signal conductors, the signal conductors being terminated to corresponding signal terminating ends, the connecting portions of the leadframe ground bus being aligned with the cables and being terminated to the ground shields of the corresponding cables to electrically common the ground shields and the leadframe ground bus; and an external ground bus separate and discrete from the leadframe ground bus, the external ground bus having ground beams and connecting portions between the ground beams, the ground beams being aligned with and coupled to the corresponding ground contacts, the connecting portions of the external ground bus being aligned with the cables and being terminated to the ground shields of the corresponding cables at an opposite side of the cables from the leadframe ground bus, the external ground bus electrically commoning the ground shields and the external ground bus.

14. The contact assembly of claim 13, wherein the ground shields of the cables are sandwiched between the connecting portions of the external ground bus and the connecting portions of the leadframe ground bus.

15. The contact assembly of claim 13, wherein the connecting portions of the external ground bus are soldered to the ground shields to mechanically and electrically connect the external ground bus to the ground shields, and wherein the connecting portions of the leadframe ground bus are soldered to the ground shields to mechanically and electrically connect the leadframe ground bus to the ground shields.

16. The contact assembly of claim 13, wherein the external ground bus includes a connecting beam extending between and connecting each of the ground fingers to common each of the ground fingers, the connecting beam being spaced apart from the connecting portions.

17. The contact assembly of claim 13, wherein the leadframe ground bus extends above the cables and is coupled to top sides of the cables and the external ground bus extends below the cables and is coupled to bottom sides of the cables.

18. The contact assembly of claim 13, wherein the external ground bus extends above the cables and is coupled to top sides of the cables and the leadframe ground bus extends below the cables and is coupled to bottom sides of the cables.

19. The contact assembly of claim 13, further comprising a strain relief element encasing portions of the signal terminating ends, the ground terminating ends, the leadframe bus bar and the external ground bus.

20. An electrical connector comprising:

a housing having a cavity receiving an upper contact assembly and a lower contact assembly, the housing including a card slot at a mating end of the housing configured to receive a card edge of a circuit card of a mating connector;

the upper contact assembly comprising:

an upper leadframe having an array of upper contacts including upper signal contacts and upper ground contacts, the upper ground contacts interspersed with the upper signal contacts to provide electrical shielding between corresponding upper signal contacts, each upper signal contact including an upper signal intermediate portion extending between an upper signal mating end and an upper signal terminating end, each upper ground contact including an upper ground intermediate portion extending between an upper ground mating end and an upper ground terminating end, the upper ground terminating end having an upper leadframe ground bus connecting each of the upper ground contacts, the upper signal mating ends and the upper ground mating ends located in the card slot for mating with the circuit card;

an upper contact holder holding the array of upper contacts, the upper contact holder being a dielectric material, the upper contact holder holding each of the upper signal intermediate portions and holding each of the upper ground intermediate portions, the upper signal mating ends and the upper ground mating ends extending forward of the upper contact holder, the upper signal terminating ends and the upper ground terminating ends extending rearward of the upper contact holder;

upper cables terminated to the upper leadframe, the upper cables including upper signal conductors and upper ground shields surrounding the corresponding upper signal conductors to provide electrical shielding for the upper signal conductors, the upper signal conductors being terminated to corresponding upper signal terminating ends, the upper leadframe ground bus being terminated to each of the upper ground shields to electrically common the upper ground shields and the upper leadframe ground bus; and an upper external ground bus separate and discrete from the upper leadframe ground bus, the upper external ground bus being terminated to each of the upper ground shields at an opposite side of the upper cables from the upper leadframe ground bus to electrically common the upper ground shields and the upper external ground bus;

the lower contact assembly comprising:

a lower leadframe having an array of lower contacts including lower signal contacts and lower ground contacts, the lower ground contacts interspersed with the lower signal contacts to provide electrical shielding between corresponding lower signal contacts, each lower signal contact including a lower signal intermediate portion extending between a lower signal mating end and a lower signal terminating end, each lower ground contact including a lower ground intermediate portion extending between a lower ground mating end and a lower ground terminating end, the lower ground terminating end having a lower leadframe ground bus connecting each of the lower ground contacts, the lower signal mating ends and the lower ground mating ends located in the card slot for mating with the circuit card;

a lower contact holder holding the array of lower contacts, the lower contact holder being coupled to the upper contact holder, the lower contact holder being a dielectric material, the lower contact holder holding each of the lower signal intermediate portions and holding each of the lower ground intermediate portions, the lower signal mating ends and the lower ground mating ends extending forward of the lower contact holder, the lower signal terminating ends and the lower ground terminating ends extending rearward of the lower contact holder;

lower cables terminated to the lower leadframe, the lower cables including lower signal conductors and lower ground shields surrounding the corresponding lower signal conductors to provide electrical shielding for the lower signal conductors, the lower signal conductors being terminated to corresponding lower signal terminating ends, the lower leadframe ground bus being terminated to each of the lower ground shields to electrically common the lower ground shields and the lower leadframe ground bus; and a lower external ground bus separate and discrete from the lower leadframe ground bus, the lower external ground bus being terminated to each of the lower ground shields at an opposite side of the lower cables from the lower leadframe ground bus to electrically common the lower ground shields and the lower external ground bus.

* * * * *